US006561286B2

(12) United States Patent
Armell et al.

(10) Patent No.: US 6,561,286 B2
(45) Date of Patent: May 13, 2003

(54) WELL BORE REAMER AND METHOD

(76) Inventors: Richard A. Armell, Nuestro Casa, Kirkton St. Cyrus, Montross, Angus, Scotland DD10 CBN (GB); Stephen L. Armell, Loyang Offshore Supply Base, Box No. 5137, Loyang Crescent, 508988 (SG)

( * ) Notice: Subject to any disclaimer, the term of this patent is extended or adjusted under 35 U.S.C. 154(b) by 0 days.

(21) Appl. No.: 10/006,420

(22) Filed: Dec. 6, 2001

(65) Prior Publication Data

US 2002/0070051 A1 Jun. 13, 2002

(30) Foreign Application Priority Data

Dec. 7, 2000 (GB) ..... 0029944

(51) Int. Cl.[7] ..... E21B 7/28
(52) U.S. Cl. ..... 175/57; 175/286; 175/406
(58) Field of Search ..... 175/57, 286, 289, 175/406, 267, 268, 269

(56) References Cited

U.S. PATENT DOCUMENTS

| | | | | | |
|---|---|---|---|---|---|
| 377,249 | A | * | 1/1888 | Grassman | 175/286 |
| 392,592 | A | * | 11/1888 | Douglass | 175/267 |
| 410,311 | A | * | 9/1889 | Chapman | 175/286 |
| 1,817,986 | A | * | 8/1931 | Kapeluchnikoff | 175/267 |
| 2,244,674 | A | * | 6/1941 | Cady | 175/289 |
| 2,756,968 | A | * | 7/1956 | Emanuel | 175/269 |
| 3,342,276 | A | * | 9/1967 | Beck, Jr. | 175/286 |
| 5,060,738 | A | * | 10/1991 | Pittard et al. | 175/267 |
| 5,385,205 | A | * | 1/1995 | Hailey | 166/55.8 |

* cited by examiner

*Primary Examiner*—Hoang Dang
(74) *Attorney, Agent, or Firm*—William Nitkin

(57) ABSTRACT

Disclosed are an expandable well bore reamer and method utilizing a pair of reaming blades pivotally mounted on a central support member, each blade having an inner and an outer mounting arm positioned on opposite sides of such central support member with a movable cam with cam members to push against the inner mounting arm of each blade to pivot the reaming blades outward to an open position.

12 Claims, 6 Drawing Sheets

WELL BORE REAMER AND METHOD

BACKGROUND OF THE INVENTION

1. Field of the Invention

This invention relates to an expandable reaming tool which can be used to drill out and ream well bores and more particularly relates to a reamer having expandable blades suitable for use in oil and gas drilling and method.

2. History of the Prior Art

When drilling a well bore, typically a large hole is first created into which is inserted a length of casing which lines the bore hole. The casing may be cemented in place and serves to prevent the bore wall from collapsing. In order to drill deeper into the bore a smaller drill bit is used together with a narrower casing to slide through the previously installed casing. Consequently, each progressive section of the bore, and the casing installed within it, has a smaller diameter to that which is above it.

When it is desired to drill a hole below an upper casing of a diameter larger than the bore of such upper casing, an expandable reaming tool is used. Such tools, sometimes referred to as underreamers, comprise a body having one or more expandable arms/blades which can move between a closed position, when the underreamer is of a narrow diameter, to fit through such upper casing, and an open position, when such underreamer expands to bore a hole below such upper casing of larger diameter than its body.

A typical prior art expanding reamer tool is shown in FIGS. 1(*a*) and (*b*). Tool 10 comprises a body 12, reaming blades 14 and 16 pivotally mounted thereon and a cam 18 to actuate reaming blades 14 and 16 from a closed position, shown in FIG. 1(*a*), for insertion through a well bore or narrow diameter upper casing, to an open position, shown in FIG. 1(*b*), for boring a wider diameter bore hole.

Such prior art reaming tool has a number of disadvantages. First, cam members 20 and 22 which are mounted on the periphery of the top of cam 18 are prone to key seating on the lower surfaces of outer mounting arms 24 and 26 of reaming blades 14 and 16 due to the constant pressure exerted on cam members 20 and 22 during boring. Secondly, the closing diameter of the tool is limited by the wide separation of cam members 20 and 22 as the cam ratio decreases by approximately three to one when reaming blades 14 and 16 open. Further, the proximity of cam members 20 and 22 to the outer edge of body 12 also leads to their being damaged by collisions with irregularities on the bore wall.

SUMMARY OF THE INVENTION

It is therefore an object of at least one embodiment of the present invention to provide a reaming tool which overcomes the aforementioned disadvantages or the prior art and provides increased stability while boring compared to the prior art.

Therefore in a first aspect of the present invention there is provided an expandable reaming tool with the tool comprising a body having a central support member along its central axis, first and second reaming blades pivoting on a spindle mounted perpendicular to the central axis, and means for laterally extending the blades from a closed position to an open position, wherein on the spindle is arranged in order: an outer mounting arm of the first reaming blade, and an inner mounting arm of the second reaming blade, the central support member, an inner mounting arm of the first reaming blade, an outer mounting arm of the second reaming blade; and the means for laterally extending the blades being at least one cam disposed immediately adjacent to said central support member, said cam actuable on at least one of the inner mounting arms of the reaming blades.

In a preferred embodiment the central support member includes a central reaming portion. The central reaming portion can be located on the end of the central support member and can be arranged as a spade point. Advantageously the central reaming portion can be located adjacent to the blades such that it is covered by the blades when the blades are in the closed position.

The blades can be mounted on a leading end of the tool. Each blade can have an outer surface, such outer surfaces being substantially plano-cylindrical such that when the blades are in the closed position they present a substantially cylindrical body with a diameter equal to the diameter of the drill body.

The blades can each include front and inner reaming portions. The front reaming portion can be located on the leading end of each of the blades when the blades are in the closed position, and the inner reaming portions can be located on the inner plano surface as seen when the blades are in the open position. Additionally the blades can include outer reaming portions on the cylindrical outer surface. The blades can further include a stop. The stop is used to restrict the lateral extension to a maximum projection. Preferably the stop is located on a lower of each blade surface between the mounting arms. The cam is slideably mounted on the central support member. An inner aperture of the cam mates closely with the outer surface of the central support member. In this way the cam can more smoothly along the central axis supported by the central support member.

The cam can, in a preferred embodiment, include two cam members. The cam members can be projections from the cam on the leading surface of the cam. The cam members can be arranged to closely abut the central support member. Further the cam members can be dimensioned to fit between the central support member and the outer mounting arms of the blades. The cam members are of a size to project upward from the cam a distance which is shorter than the distance between the leading edge of the cam and a lower surface of the outer mounting arms when the blades are in a closed position. When the cam moves up the central support member, the leading edge of each cam member passes inside the space between the outer mounting arms of each blade and the central support member and only contacts the lower surface of at least one of the inner mounting arms to force the blades into an open position. The cam member do not strike or actuate the outer mounting arms.

Thus the device of this invention provides a method of laterally extending an expandable reaming tool, such method including the steps of driving the cam along the central support member and on its journey, causing contact of the cam members mounted on the cam against the lower surfaces of the inner mounting arms of the blades to force the blades to laterally extend, and as the blades laterally extend causing contact of the lower surfaces of the outer mounting arms against the leading edge of the cam.

Such method can further include the step of stopping the lateral extension of the blades at a desired lateral extension. In a preferred method the blades are stopped when a stop member meets the central support member.

Such preferred method can include stopping the lateral extension of the blades when the blades are at an angle of 75 degrees from the central axis.

BRIEF DESCRIPTION OF THE DRAWINGS

FIG. 1(*b*) illustrates a perspective view of the reaming tool of FIG. 1 in an open position.

DESCRIPTION OF THE PREFERRED EMBODIMENT(S)

Figure 1A:
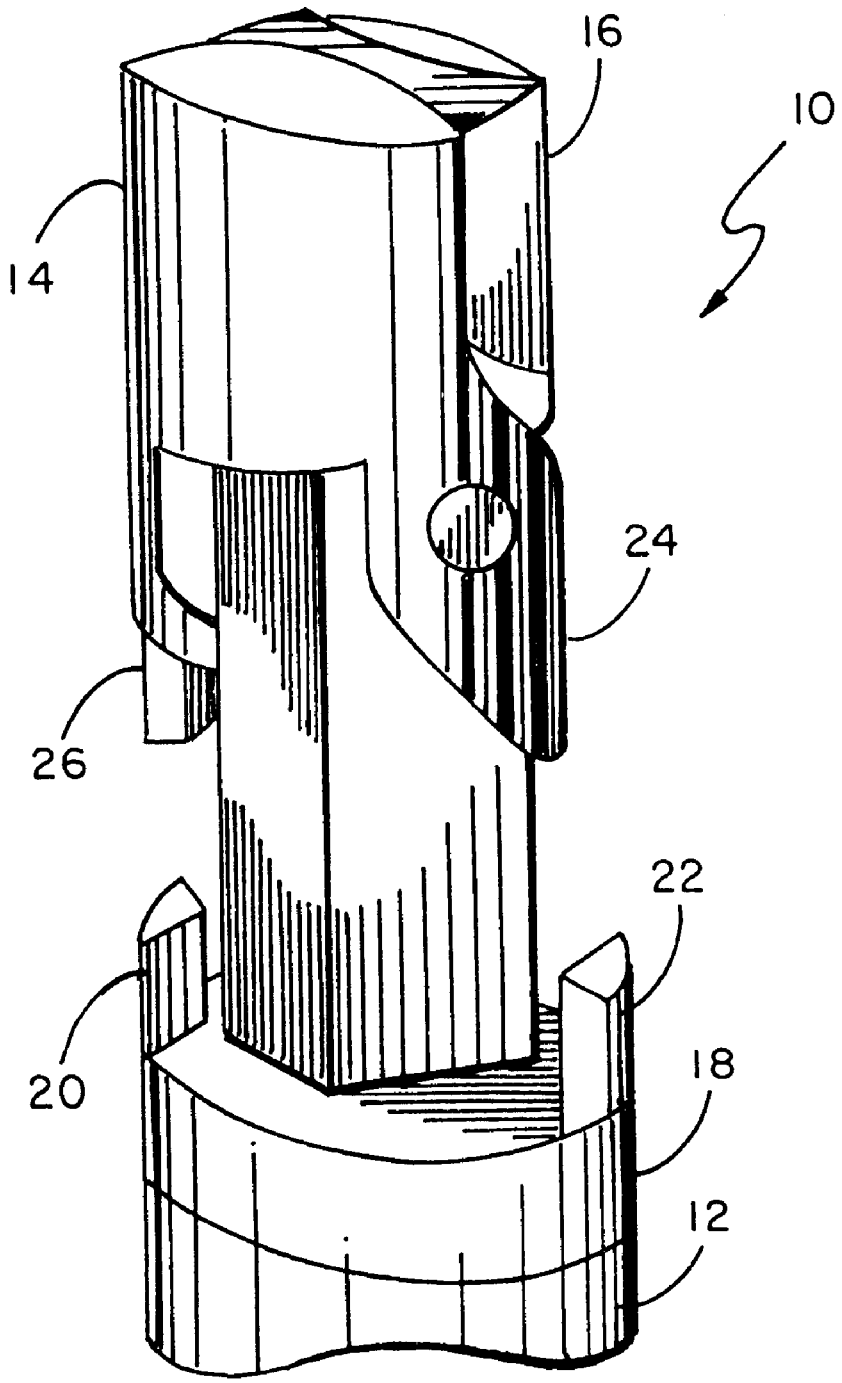
FIG. 1A PRIOR ART
FIG. 1(*a*) illustrates a perspective view of a reaming tool of the prior art in a closed position.
Figure 1B:
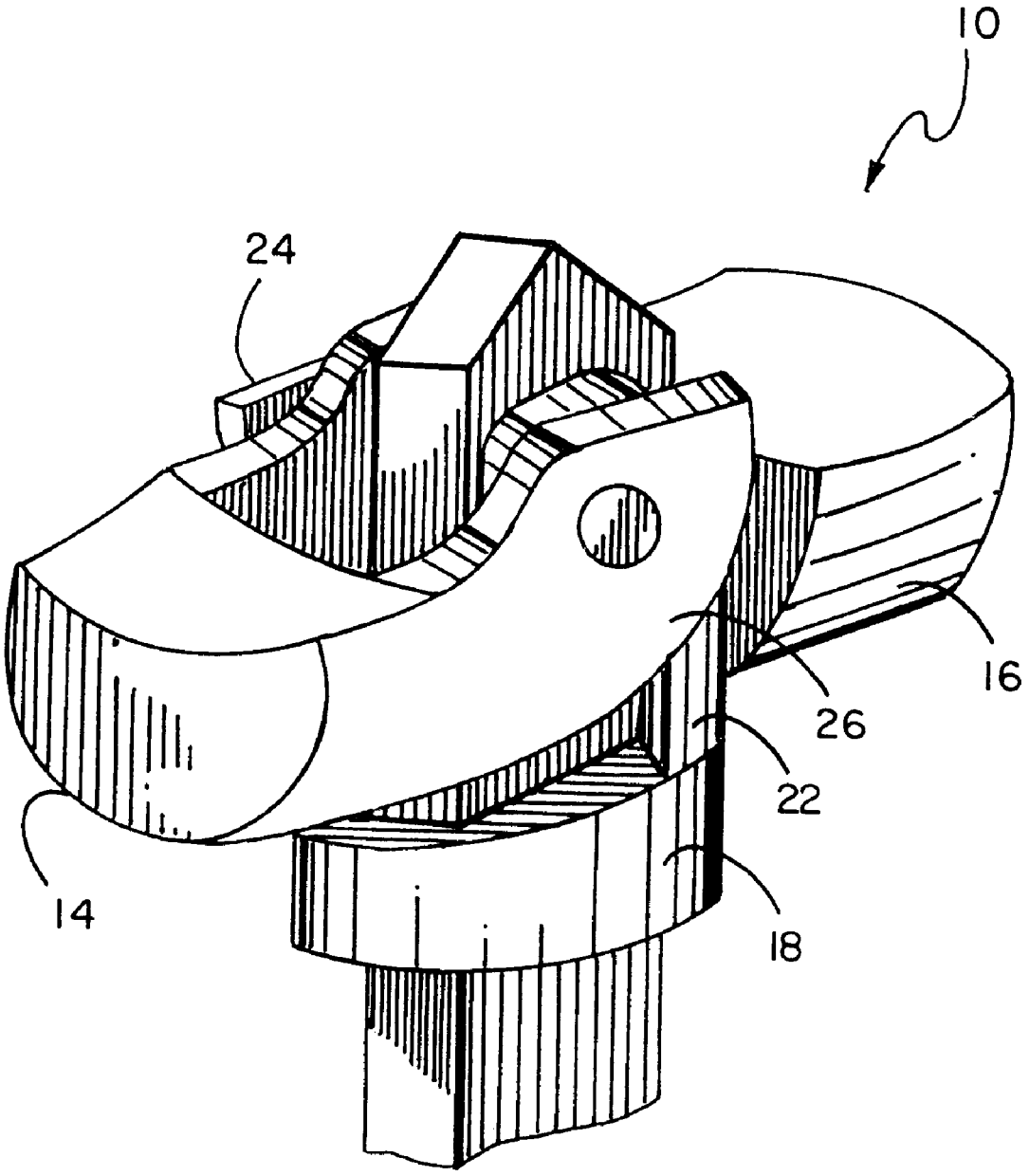
FIG. 1B PRIOR ART
Figure 2B:
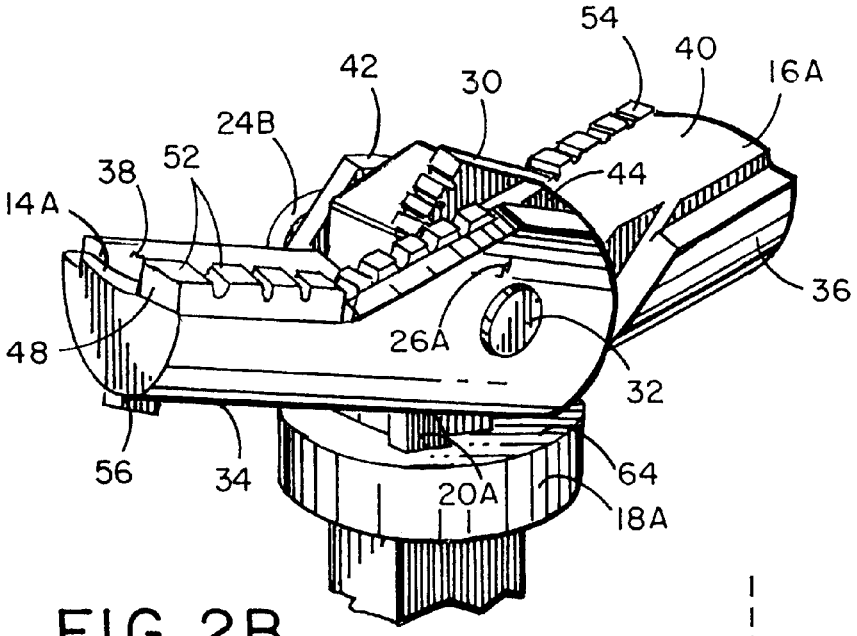
FIG. 2(B) illustrates a perspective view of a reaming tool in accordance with the present invention in an open position.
Figure 2A:
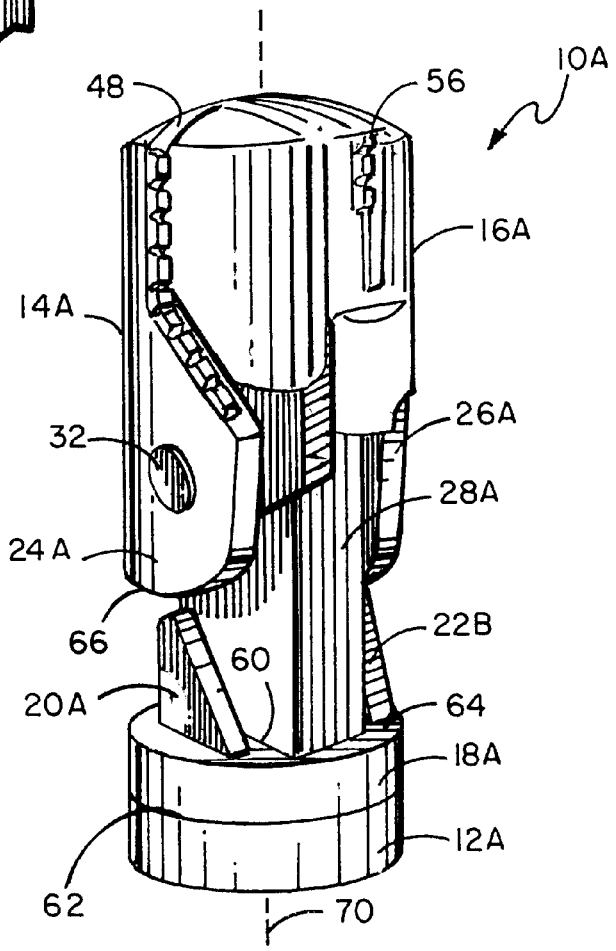
FIG. 2(A) illustrates a perspective view of a reaming tool in accordance with the present invention in a closed position.

Reference is made to FIGS. 2(A) and 2(B) of the drawings which depict the reaming tool, generally indicated by reference numeral 10A, according to a first embodiment of the present invention. Similar parts of the present invention to those parts of the prior art reaming tool shown in FIGS. 1(*a*) and 1(*b*) have been given the same reference numeral but are suffixed "A".

As seen in FIGS. 2(A) and 2(B), tool 10A comprises a cylindrical body 12A onto which are mounted first and second reaming blades 14A and 16A and cam 18A to actuate movement of reaming blades 14A and 16A. At the rear of the cylindrical body 12A are connections to an hydraulic work string which are not shown but which means to provide hydraulic force to tools is well known. At a leading end of cylindrical body 12A is central support member 28A aligned with the central axis 70 of body 12A. Central support member 28A can be rectangular in cross-section. At the leading edge of central support member 28A is spade point 30 seen in FIG. 2B providing a cutting edge in the form of a reamer. Positioned through central support member 28, perpendicular to the central axis, is spindle 32 which is mounted so that first and second reaming blades 14A and 16A can pivot on spindle 32.

Figure 3:
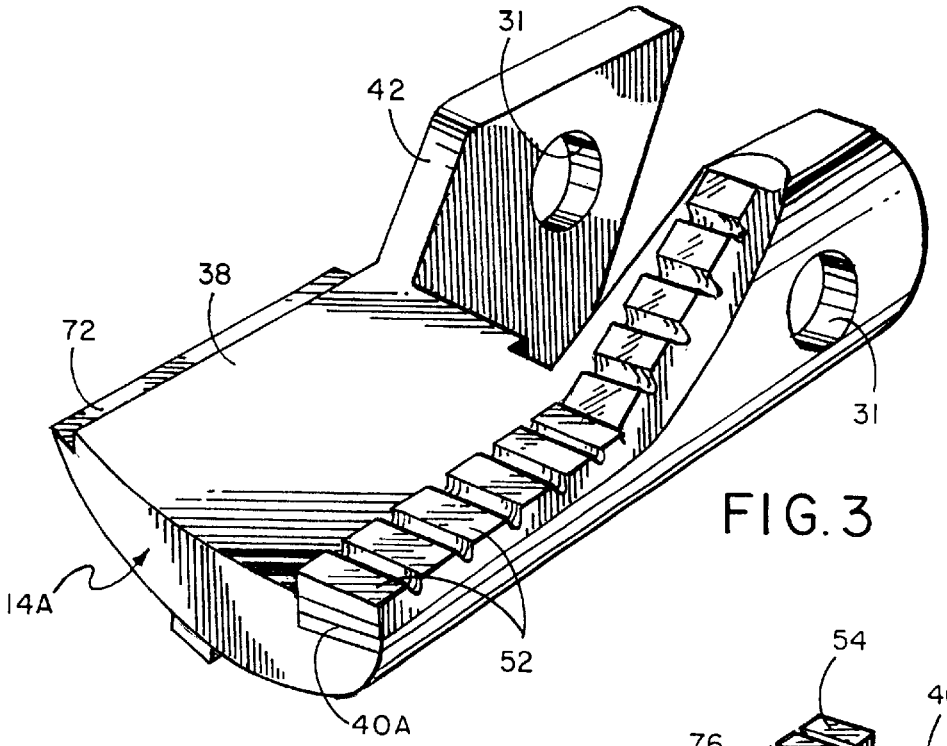
FIG. 3 illustrates a perspective view of a reaming blade.
Figure 4:
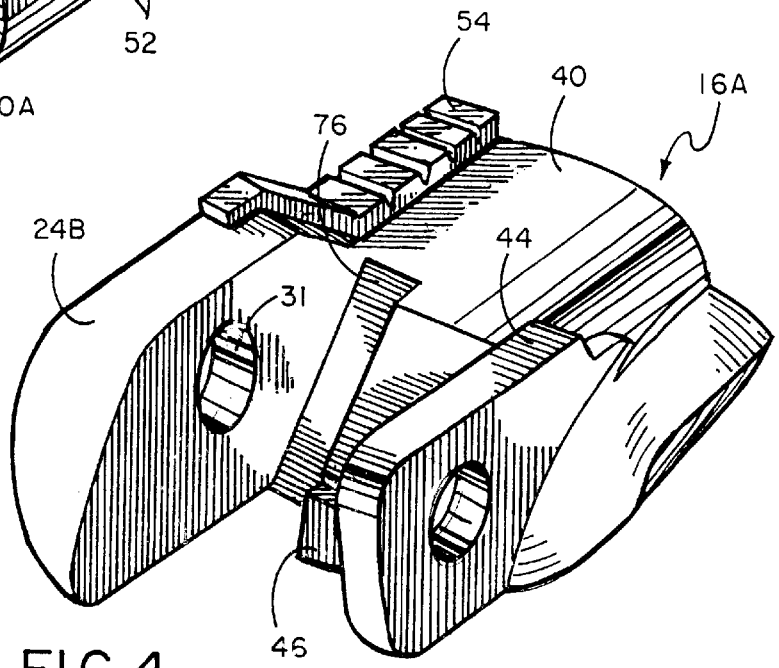
FIG. 4 illustrates a perspective view of the reaming blade of FIG. 3 from a different angle.
Figure 5:
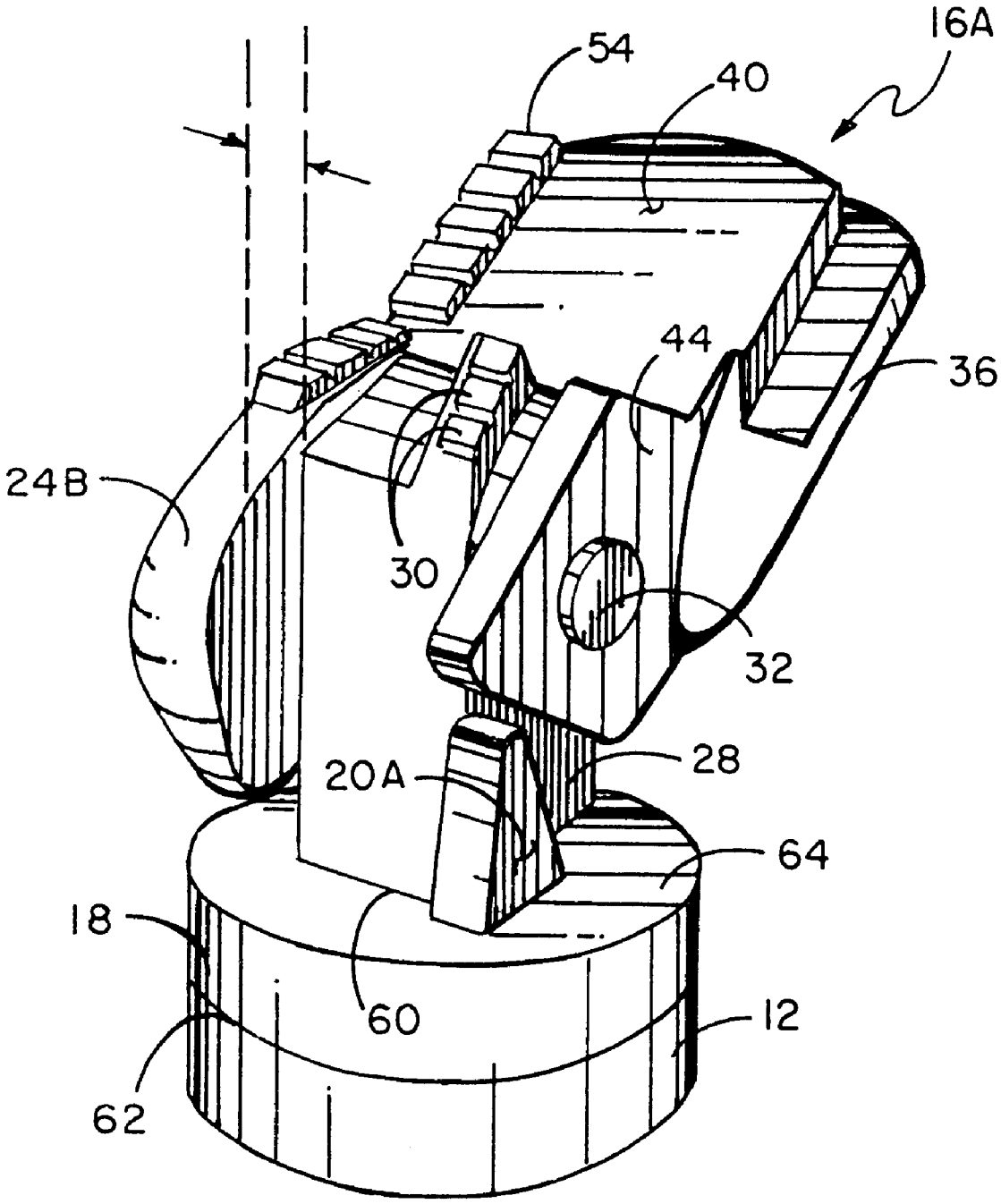
FIG. 5 illustrates a perspective view of a reaming blade mounted on the central support member.

Each reaming blade 14A and 16A has a plano-cylindrical surface. Outer surfaces 34 and 36 of first and second reaming blades 14A and 16A are each cylindrical and the inner surfaces 38 and 40 of first and second reaming blades 14A and 16A are each planar. At the rear of first and second reaming blades 14A and 16A are located, respectively, first and second inner mounting arms 42 and 44 and first and second outer mounting arms 24A and 26A. First and second outer mounting arms 24A and 26A have an outer surface matching the contour of the outer surfaces 34 and 36 of the reaming blades and the outer surface of body 12A. The first and second outer mounting arms 24A and 26A and first and second inner mounting arms 42 and 44 are arranged on spindle 32 such that in order along the spindle lie first outer mounting arm 24A of first reaming blade 14A, inner mounting arm 44 of second reaming blade 16B, central support member 28, inner mounting arm 42 of first reaming blade 14A, and outer mounting arm 26A of second reaming blade 16A. FIG. 5 illustrates only second reaming blade 16A mounted on central support member 28 while FIG. 3 illustrates first reaming blade 14A separate from the rest of the structure. Located between the arms of each reaming blade is a stop, such as stop 46 seen in FIG. 4, provided by a ridge of the blade. On the leading edge of first and second reaming blades 14A and 16A are located first and second front reamer cutters 48 and 50. On edges of inner surfaces 38 and 40 are located first and second inner reamer cutters 52 and 54. In the embodiment shown first and second front reamer cutters 48 and 50 and first and second inner reamer cutters 52 and 54 are mounted respectively onto first and second reaming blades 14A and 16A as single reamer cutters, respectively. Further, first and second outer reamer cutters 56 and 58 are arranged respectively on outer surfaces 34 and 36 of first and second reaming blades 14A and 16A.

Cam 18 is a cylindrical disk having a rectangular aperture 60 defined therein through the center thereof. Cam 18 is mounted on central support member 28; and as the outer surface of central support member 28 matches the inner surface of aperture 60, cam 18 slides smoothly over central support member 28 when pressure is applied to back surface 62 of cam 18. Lubrication can be applied to central support member 28 to aid movement of cam 18 thereon. On leading surface 64 of cam 18 are arranged first and second cam members 20A and 22A. Only one cam member 20A is substantially shown in FIGS. 2(A) and 2(B), but it will be appreciated that second cam member 22A is arranged identically to first cam member 20A on the other side of central support member 28. As can be seen in FIG. 2(A), first and second cam members 20A and 22A have a width which allows them to fit respectively between central support member 28 and first and second outer mounting arms 24A and 26A. In the embodiment shown, the height of cam members 20A and 22A is selected so that when the reaming blades are in the open position, as seen in FIG. 2(B), first and second inner mounting arms 42 and 44 rest respectively against first and second cam member 22A and 20A, and first and second lower surfaces 66 and 68 of first and second outer mounting arms 24A and 26A respectively rest against leading surface 64 of cam 18A.

In use, tool 10A in the closed position is inserted into a bore hole or through a casing in the closed position. In the closed position spade point 30 is covered by first and second reaming blades 14A and 16A. First and second reaming blades 14A and 16A lie along central axis 70, and inner surfaces 38 and 40 of the blades rest against each other.

When the path of tool 10A is impeded, tool 10A can be rotated so that first and second front reamers 48 and 50 and first and second outer reamers 56 and 58 cut through the impeding material to extend the depth of the bore hole.

Figure 6:
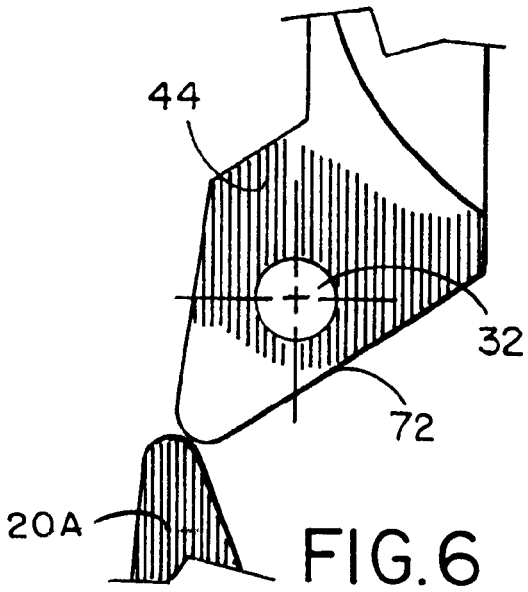
FIG. 6 illustrates a side view of a section of an inner mounting arm of a reaming blade aligned with a cam member.
Figure 7:
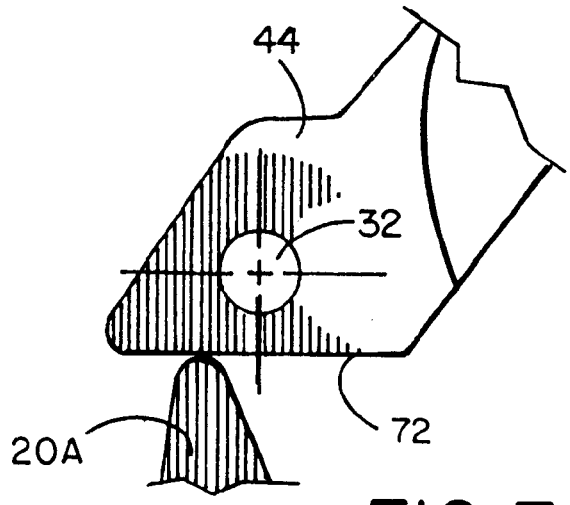
FIG. 7 illustrates a side view of the section of the inner mounting arm of FIG. 6 in a different, more advanced position in the blade-opening process.
Figure 8:
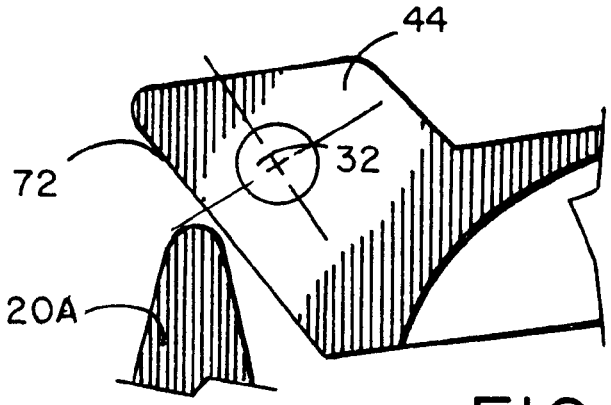
FIG. 8 illustrates a side view of the section of the inner mounting arm of FIG. 7 in yet a further advanced position in the blade-opening process.

At a desired depth in the bore hole, pressure can be applied through an hydraulic work string to cam 18A. Cam 18A then travels along central support member 28A. During this travel first and second cam members 20A and 22A slide behind and within first and second outer mounting arms 24A and 26A, contacting first and second inner mounting arms 42 and 44; and the blades are forced laterally outwards as the tops of first and second cam members 20A and 22A ride respectively along first and second lower surfaces 72 and 74 of first and second inner mounting arms 42 and 44, as seen in FIGS. 6, 7 and 8, and the lower surfaces 66 of first and second outer mounting arms 24A and 26A ride across lead surface 64 of cam 18, such as lower surface 66 seen in FIG. 2B.

Lateral extensions of first and second reaming blades 14A and 16A can be halted at any time by stopping the pressure on back surface 62 of cam 18A. The maximum angle the blades can be laterally extended through is limited at the point at which stop 46, seen in FIG. 4, contacts the surface of central support member 28. The distance between the first and second outer reamer cutters 56 and 58 at the leading edge of tool 10A gives the diameter of the hole which can be bored by tool 10A when closed. During opening of blades 14A and 16A and when the blades are in the fall open position, tool 10A is rotated, with the first and second inner reamers 52 and 54 and the reamers on spade point 30 providing a boring action so as to extend the diameter of the bore hole.

In a preferred embodiment of tool 10A, the lateral extension of the blades is limited to 75 degrees from central axis 70. This angle is the optimum angle to give stabilization to tool 10A by the profile of the cut, i.e. concave. The total area on the outer diameter of the blades is the area providing stabilization. In addition, this angle provides a tool which drills the maximum hole size at which the blades can be easily retracted. For example, prior art tools extend to 90 degrees. Thus when prior art tools are retracted from the bore hole, planar surfaces on the leading edge of the blades describe a circumference which can be greater than the diameter of the hole, thus the blades may "stick".

The principal advantages of the present invention are that by actuating the blades via the inner mounting arms, the outer mounting arms engage the leading edge of the cam, keeping mechanical advantage on the blades. When open, the cam members are not bearing all the load so that key seating is avoided. It should be understood that the cam members can be actuated separately but mutual to each other. Further the reamers can also have different cutting profiles from those shown in the figures, and the reamer cutters can cover larger or smaller portions of the surfaces of the blades without departing from the spirit and scope of this invention.

Although the present invention has been described with reference to particular embodiments, it will be apparent to those skilled in the art that variations and modifications can be substituted therefor without departing from the principles and spirit of the invention.

We claim:

1. A well bore reamer comprising:

a body having a central axis;

a central support member extending from said body along said central axis, said central support member having an end and an aperture defined perpendicularly therethrough near said end;

a cam having a peripheral side edge, a leading edge and an aperture defined therein for receipt of said central support member;

means to move said cam on said central support member;

first and second cam members positioned on said leading edge of said cam immediately adjacent to said aperture defined in said cam and positioned away from said peripheral side edge of said cam;

first and second reaming blades, each having a leading edge, a front, an outer mounting arm and an inner mounting arm spaced apart from one another, each of said outer mounting arms having a lower edge, each of said first and second reaming blades being substantially plano-cylindrical in shape and having aligned apertures defined through said outer and inner mounting arms, said first and second reaming blades positioned with their planar sides aligned with one another with said outer mounting arm of each reaming blade positioned aligned with said peripheral side edge of said cam, said inner mounting arms of each reaming blade positioned on opposite sides of said central support member from one another between said outer mounting arms with said apertures aligning with said aperture defined in said central support member, said first and second reaming blades each having a leading edge;

a spindle member positioned through said apertures defined in said outer mounting arm of said first reaming blade, said aperture in said inner mounting arm of said second reaming blade, said aperture defined in said central support member, said aperture defined in said inner mounting arm of said first reaming blade, and said aperture defined in said outer mounting arm of said second reaming blade; and said structure arranged such that when said cam is moved forward, said first and second cam members disposed on each side of said central support member pass within and between said outer mounting arms of said first and second reaming blades and contact said inner mounting arms of said first and second reaming blades, pushing said inner mounting arms such that said first and second reaming blades pivot on said spindle member, causing them to open outwardly at an angle to said central axis to a second mode open position; and when said cam is withdrawn from its forward position, said first and second reaming blades return to a first mode closed position with said planar surfaces of each reaming blade coming into contact with one another.

2. The well bore reamer of claim 1 further including a spade point defined at said end of said central support member for aid in cutting during drilling.

3. The well bore reamer of claim 2 wherein in said open position, said lower edges of said outer mounting arms of said first and second reamer blades are disposed against said leading edge of said cam.

4. The well bore reamer of claim 3 further including first and second front reamer cutters positioned on said front of each of said first and second reaming blades.

5. The well bore reamer of claim 4 further including first and second outer reamer cutters positioned respectively on said cylindrical portions of said first and second reaming blades.

6. The well bore reamer of claim 5 further including inner reamer cutters positioned respectively on said leading edges of said first and second reaming blades.

7. The well bore reamer of claim 6 wherein said first and second inner mounting arms of said first and second reaming blades each has a lower surface which, when said well bore reamer is in said closed position, is defined at an angle to said central axis and when said cam members make contact with said angled lower surfaces, said first and second inner mounting arms are forced to rotate at an angle around said spindle member to open said first and second reaming blades away from one another.

8. The well bore reamer of claim 7 further including stop members positioned between said inner and outer mounting arms of said first and second reaming blades, said stop member adapted to contact said central support member at a desired angular position of said first and second reaming blades to said central axis to stop further opening of said first and second reaming blades.

9. A method of under reaming a bore hole comprising the steps of:

providing a reamer having:

a body having a central axis;

a central support member extending from said body along said central axis, said central support member having an end and an aperture defined perpendicularly therethrough near said end;

a cam having a peripheral side edge, a leading edge and an aperture defined therein for receipt of said central support member;

means to move said cam on said central support member;

first and second cam members positioned on said leading edge of said cam immediately adjacent to said aperture defined in said cam and positioned away from said peripheral side edge of said cam;

first and second reaming blades, each having a leading edge, a front, an outer mounting arm and an inner mounting arm spaced apart from one another, each of said outer mounting arms having a lower edge, each of said first and second reaming blades being substantially plano-cylindrical in shape and having aligned apertures defined through said outer and inner mounting arms; said first and second reaming blades positioned with their planar sides aligned with one another with said outer mounting arm of each reaming blade positioned aligned with said peripheral side edge of said cam, said inner mounting arms of each reaming blade positioned on opposite sides of said central support member from one another between said outer mounting arms with said apertures aligning with said aperture defined in said central support member, said first and second reaming blades each having a leading edge;

a spindle member positioned through said apertures defined in said outer mounting arm of said first reaming blade, said aperture defined in said inner mounting arm of said second reaming blade, said aperture defined in said central support member, said aperture defined in said inner mounting arm of said first reaming blade, and said aperture defined in said outer mounting arm of said second reaming blade;

moving said cam and said first and second cam members forward;

disposing said first and second cam members on opposite sides of said central support member;

passing said first and second cam members between said outer mounting arms;

contacting said inner mounting arms by said first and second cam members;

pushing said inner mounting arms to rotate on said spindle by said contacting and movement of said first and second cam members against said inner mounting arms of said first and second reaming blades;

opening said first and second reaming blades outward at an angle to said central axis by said rotation to an open position mode; and rotating said reamer to under ream a bore hole.

10. The method of claim 9 further including the steps of:

moving said cam rearwards so as not to contact said inner mounting arms;

rotating said inner mounting arms to a closed position around said spindle with said planar surfaces of said first and second reaming blades coming together to a closed position to take up less space in said bore hole; and withdrawing said reamer from said bore hole.

11. The method of claim 10 further including before the step of rotating said reamer to under ream a bore hole, the step of:

stopping the opening of said first and second reaming blades at a desired angle to said central axis.

12. The method of claim 11 wherein said step of stopping said opening of said first and second reaming blades at a desired angle to said central axis includes the step of stopping said opening when said first and second reaming blades are at an angle of 75 degrees to said central axis.

* * * * *